US005335825A

United States Patent [19]

Fort

[11] Patent Number: 5,335,825

[45] Date of Patent: Aug. 9, 1994

[54] METHOD AND APPARATUS FOR DISPENSING MULTIPLE BEADS OF VISCOUS LIQUID

[75] Inventor: Wesley Fort, Norcross, Ga.

[73] Assignee: Nordson Corporation, Westlake, Ohio

[21] Appl. No.: 120,638

[22] Filed: Sep. 13, 1993

Related U.S. Application Data

[63] Continuation of Ser. No. 786,901, Nov. 1, 1991, abandoned.

[51] Int. Cl.[5] ..... B67D 5/00

[52] U.S. Cl. ..... 222/1; 222/330; 222/571

[58] Field of Search ..... 239/104, 553.5, 565, 239/566, 590.5; 222/109, 188, 204, 205, 330, 571, 1

[56] References Cited

U.S. PATENT DOCUMENTS

| | | | |
|---|---|---|---|
| 1,946,339 | 2/1934 | Vigers et al. | 239/590.5 |
| 2,414,873 | 1/1947 | Herbst | 239/553 X |
| 2,697,446 | 12/1954 | Harrington | 222/571 X |
| 2,957,489 | 10/1960 | Fisher | 222/571 X |
| 3,126,574 | 3/1964 | Fox | 239/566 X |
| 3,327,680 | 6/1967 | Talbot | 118/411 |
| 3,570,725 | 3/1971 | Baker et al. | 222/504 |
| 3,788,561 | 1/1974 | Vilagi et al. | 239/553.5 |
| 3,840,158 | 10/1974 | Baker et al. | 222/487 |
| 3,849,241 | 11/1974 | Butin et al. | 161/169 |
| 4,220,114 | 9/1980 | Radowicz | 118/411 |
| 4,534,388 | 8/1985 | Pall et al. | 239/104 X |
| 4,550,681 | 11/1985 | Zimmer et al. | 118/410 |
| 4,572,435 | 2/1986 | Thompson | 239/590.5 X |
| 4,675,208 | 6/1987 | Kageyama et al. | 118/410 X |
| 4,687,137 | 8/1987 | Boger et al. | 239/553.5 X |
| 4,735,169 | 4/1988 | Cawston et al. | 118/411 |
| 4,774,109 | 9/1988 | Hadzimihalis et al. | 118/410 X |
| 5,024,709 | 6/1991 | Faulkner, III et al. | 118/411 X |
| 5,027,976 | 7/1991 | Scholl et al. | 222/1 |
| 5,162,121 | 11/1992 | Kawaguchi | 425/130 |

FOREIGN PATENT DOCUMENTS 8533284 of 1986 Fed. Rep. of Germany .

7339050 11/1973 France .

OTHER PUBLICATIONS

Nordson Drawing No. 803070, Nordson Corporation, Amherst, Ohio 44001. May 6, 1980.

Nordson Drawing No. 803083, Nordson Corporation, Amherst, Ohio 44001. May 19, 1980.

"MultiLine Extrusion Applicators ML 400 Series", Slautterback Corporation Technical Bulletin TB033, revised Jul. 20, 1990.

"New Multi-Orifice Nozzle", *The Melting Pot*, internal publication of Nordson Corporation, Amherst, Ohio, vol. 2, Issue 1, p. 4. Jan. 1981.

"Wide Band Extrusion Nozzles", brochure of Acumeter Laboratories Incorporated, Marlborough, Mass. May 1983.

"Multi-Line Nozzle", a page from a Technical Bulletin, p. 30, of Nordson Corporation of Atlanta, Ga. Oct. 1986.

"Multiline Extrusion Applicators ML 400 Series", from a Technical Bulletin of Slautterback Corporation, revised Mar. 1, 1990.

*Primary Examiner*—Andres Kashnikow
*Assistant Examiner*—Kenneth Bomberg
*Attorney, Agent, or Firm*—Wood, Herron & Evans

[57] ABSTRACT

A method and apparatus for dispensing multiple, closely spaced beads of viscous liquids such as hot melt thermoplastic adhesive is provided which comprises a dispensing device including a nozzle assembly having a nozzle body connected to a nozzle plate carrying a number of closely spaced nozzle tips. The nozzle body is formed with an internal adhesive flow passage terminating with an elongated distribution channel having an outlet. A number of comparatively small diameter discharge passageways are formed in the nozzle plate, each connected to one nozzle tip, and structure is provided for transferring the adhesive from the elongated distribution channel in the nozzle body into each of the discharge passageways, against the influence of gravity, for discharge from the nozzle tips as individual extruded beads.

24 Claims, 7 Drawing Sheets

METHOD AND APPARATUS FOR DISPENSING MULTIPLE BEADS OF VISCOUS LIQUID

This application is a continuation, of application Ser. No. 07/786,902 filed Nov. 1, 1991, now abandoned.

FIELD OF THE INVENTION

This invention relates to a method and apparatus for dispensing multiple beads of viscous liquid, and, more particularly, to a method and apparatus for dispensing multiple beads of hot melt thermoplastic adhesive onto a substrate from closely spaced nozzle tips which do not contact the substrate wherein the beads can be dispensed intermittently without "cut off drool", i.e., the escape of adhesive in string or strand form from the discharge outlet of the nozzle tips when the flow of adhesive is intermittently interrupted.

BACKGROUND OF THE INVENTION

Many applications require the placement of a number of closely spaced beads of viscous liquid such as hot melt thermoplastic material. For example, in securing the flaps of cartons or other paper products, or in attaching the backing sheet to the non-woven layer of a hygienic article, rows of closely spaced hot melt adhesive beads are intermittently applied to such substrates to provide the desired bond. In applications of this type, the problems which have confronted designers include the accurate placement of a large number of relatively thin beads in a small area and a capability of turning on and off the flow of such beads without "cut off drool", i.e., the formation of elongated strands or strings after flow of the material is terminated.

One approach to the problem of locating a number of thin beads in a small area is disclosed, for example, in U.S. Pat. Nos. 3,570,725 and 3,840,158. In these patents, a number of dispensing devices or guns each having a nozzle are oriented with respect to a moving substrate such that each dispenser discharges a separate bead onto a common target area. In the U.S. Pat. No. 3,570,725, each dispenser or gun is fed by a separate adhesive line, whereas the U.S. Pat. No. 3,840,158 discloses a number of small guns mounted to a common source or manifold from which the adhesive is supplied. The problem with systems of the type described in these patents is that a relatively large amount of hardware is required in order to supply adhesive to the dispensers and provide controls for turning on and off the dispensers to obtain intermittent application of the adhesive beads. Additionally, the spacing between adjacent beads is limited by the size of the dispensers, which, in many applications, produces a wider spacing between beads than is needed.

With respect to the problem of cut off drool resulting from intermittent operation of adhesive dispensers, systems have been proposed of the type disclosed, for example, in U.S. Pat. Nos. 4,687,137, owned by the assignee of this invention. U.S. Pat. No. 4,687,137 to Boger et al discloses an apparatus for dispensing beads of thermoplastic adhesive onto the non-woven layer of disposable diapers using a "coat hanger" die nozzle comprising a pair of die halves which together form channels for transmitting separate streams of adhesive to discharge outlets from which the adhesive is extruded as beads onto a substrate. While this apparatus can be operated intermittently with minimal cut off drool, coat hanger die nozzles are relatively expensive to produce and can clog or plug if the adhesive becomes contaminated with particles or the like. In the event of a clog, it is time-consuming to disassemble and clean such coat hanger dies.

SUMMARY OF THE INVENTION

It is therefore among the objectives of this invention to provide a method and apparatus for dispensing multiple, parallel beads of viscous liquid such as hot melt thermoplastic adhesive which is inexpensive to construct and maintain, which is readily adapted for different bead spacings and bead sizes, and which substantially eliminates cut off drool when intermittently dispensing viscous liquids.

These objectives are accomplished in a method and apparatus for dispensing multiple, closely spaced beads of viscous liquids such as hot melt thermoplastic adhesive onto a substrate which, in one presently preferred embodiment, comprises a dispensing device including a nozzle assembly having a nozzle body connected to a nozzle plate carrying a number of closely spaced nozzle tips which do not contact the substrate. The nozzle body is formed with an internal adhesive flow passage terminating with an elongated distribution channel having an outlet. A number of comparatively small diameter discharge passageways are formed in the nozzle plate, each connected to one nozzle tip, and means are provided for transferring the adhesive from the elongated distribution channel in the nozzle body into each of these discharge passageways, against the influence of gravity, for discharge from the nozzle tips as individual extruded beads. In an alternative embodiment, the nozzle plate is eliminated and the nozzle body is formed with both the internal flow passage and discharge passages. A number of connector bores interconnect the distribution channel or bore of the internal flow passage with the discharge passages to transfer adhesive therebetween.

In either embodiment, this invention is predicated upon the concept of providing a flow path from the valve mechanism of the dispensing device to the discharge outlet of a number of closely spaced nozzle tips wherein the flow of adhesive can be intermittently interrupted without creating leakage or cut off drool of adhesive from the nozzle tips. This is accomplished by locating the outlet of the distribution bore or channel vertically below the inlet of each of the discharge passageways, and by forming at least the inlet portion of the discharge passageways with a smaller cross sectional area than that of the distribution bore or channel. The vertical distance between the outlet of the distribution bore or channel and the inlet of each discharge passageway substantially prevents adhesive upstream from the nozzle tips from flowing into and through the nozzle tips to create cut off drool. The reduced cross sectional area of the inlet portion of each discharge passageway creates a back pressure in an upstream direction relative to the nozzle tips which substantially prevents leakage of the adhesive remaining within the nozzle tips when the dispenser is operated intermittently.

In the embodiment of this invention which includes both a nozzle body and a nozzle plate, the distribution channel in the nozzle body extends longitudinally along substantially its entire length, and inwardly from a first surface thereof. The nozzle plate is formed with an inner face which abuts the first surface of the nozzle body. Each of the discharge passageways is substantially L-shaped including a horizontally oriented inlet portion extending inwardly from the inner face of the nozzle plate, and a vertically oriented outlet portion which is connected to one of the nozzle tips. When the nozzle plate is mounted to the nozzle body, the inlet portion of each discharge passageway in the nozzle plate is located vertically above the outlet of the distribution channel in the nozzle body. The adhesive must therefore flow vertically upwardly, against the influence of gravity, in the course of passage from the distribution channel in the nozzle body into the inlet portion of each discharge passageway in the nozzle plate.

In one presently preferred embodiment, the means for transferring adhesive between the distribution channel and discharge passageways comprises a shim interposed between the abutting surfaces of the nozzle body and nozzle plate. The shim is formed with a number of longitudinally spaced, vertically oriented oval-shaped slots each having a lower end communicating with the distribution channel of the nozzle body, and an upper end connected to the inlet portion of one of the discharge passageways in the nozzle plate. In an alternative embodiment, the shim is formed with an elongated, longitudinally extending slot instead of a number of upright, oval slots. The lower portion of this elongated slot communicates with the distribution channel in the nozzle body, and the upper portion thereof is connected to the inlet portion of each discharge passageway in the nozzle plate. In either embodiment, the individual oval slots and the elongated slot provide a flow path for the adhesive between the distribution channel and the discharge passageways.

In alternative embodiments of the adhesive transfer means, an elongated slot is formed in the nozzle plate which extends inwardly from its inner face and longitudinally along substantially the entire length thereof. The elongated distribution channel in the nozzle body communicates with the lower portion of the elongated slot in the nozzle plate, and the upper end of the elongated slot is connected to the inlet portion of each discharge passageway in the nozzle plate thus forming a vertically upwardly extending flow path for the adhesive between the nozzle body and the nozzle plate.

As mentioned above, an alternative embodiment of the nozzle assembly of this invention includes a nozzle body which is formed with both an internal flow passage and discharge passageways, with the nozzle plate of the above-described embodiment being eliminated. The internal flow passage includes an elongated distribution bore which is located vertically beneath the inlet portion of each discharge passageway. The discharge passageways are longitudinally spaced along the distribution bore and connector bores, which are angled vertically upwardly, interconnect the distribution bore with the inlet portion of each discharge passageway.

In each of the embodiments of the nozzle assembly herein, the inlet portion of each discharge passageway is preferably formed with a cross sectional area which is less than the cross sectional area of the distribution bore or channel. Because of this decrease in size of the flow path for the adhesive, the velocity of the adhesive is increased in the course of passage to and through the discharge passageways, at constant flow rate and pressure, so that it flows through the discharge passageways and nozzle tips at a faster rate than through the distribution bore or channel. The increased velocity of the adhesive within the discharge passageways and nozzle tips contributes to an increased "machineability" or shear capability such that the adhesive stream flowing therethrough can be more quickly and cleanly sheared in response to the termination of adhesive flow. As a result, the adhesive within the discharge passageways and nozzle tips is sheared at a point further upstream than had been possible in prior devices, thus reducing the volume of adhesive within the nozzle tips which can leak outwardly therefrom when the flow of adhesive is terminated. In addition to the rapid and clean shearing of the adhesive further upstream within the nozzle tips, the comparatively smaller diameter discharge passageways create a back pressure which tends to draw or pull any adhesive remaining within the nozzle tips in an upstream direction to prevent leakage from the discharge outlets thereof. This back pressure also assists in creating a uniform volume of adhesive along the entire length of the longitudinally extending distribution bore or channel, so that the volume or quantity of adhesive supplied to each of the discharge passageways is substantially identical. As a result, adhesive beads are emitted from each of the nozzle tips which have substantially the same quantity of adhesive and the same bead size.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
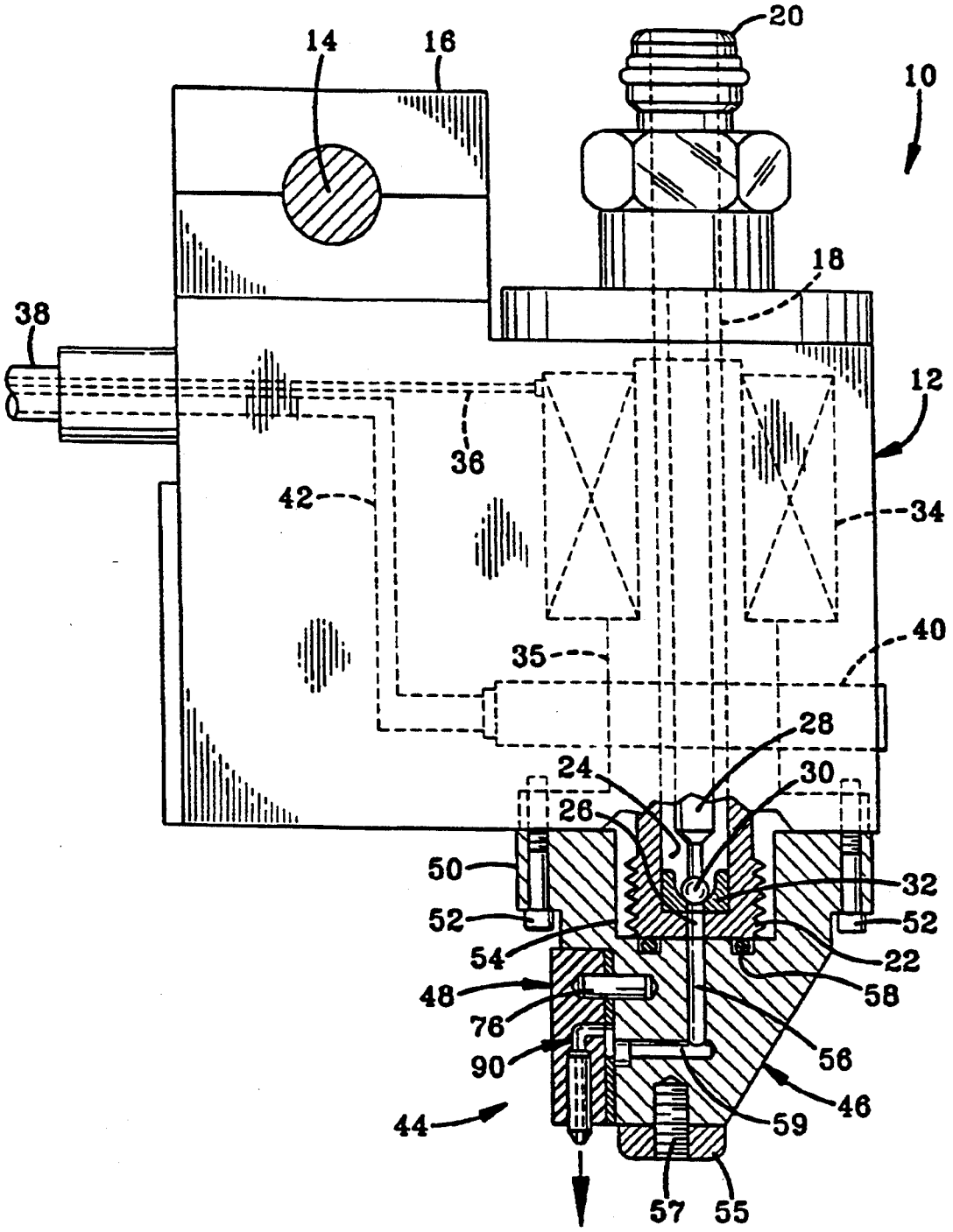
FIG. 1 is a schematic view in partial cross section of the nozzle assembly of this invention mounted to an adhesive dispenser.
Figure 2:
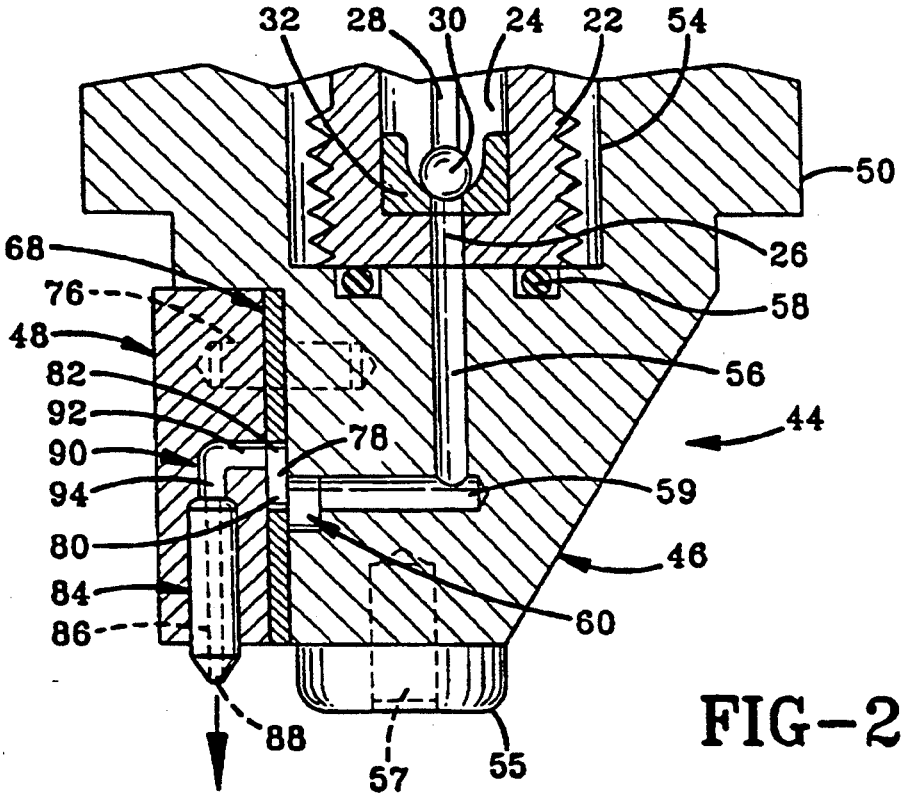
FIG. 2 is an enlarged view of the nozzle assembly shown in FIG. 1.

Referring now to FIGS. 1 and 2, an adhesive dispenser 10 is illustrated of the type disclosed in U.S. Pat. No. 5,027,976 to Scholl et al, owned by the assignee of this invention, the disclosure of which is incorporated by reference in its entirety herein. The structural details of the dispenser 10 form no part of this invention, and are discussed briefly herein for purposes of describing a supply of adhesive to the various nozzle assemblies herein. As shown in FIG. 1, the dispenser 10 includes a dispenser body 12 which is supported on a mounting rod 14 by a mounting block 16. The dispenser body 12 is formed with an adhesive passageway 18 connected by a line 20 to a source of heated, hot melt thermoplastic adhesive (not shown). The adhesive passageway 18 extends to the base of the dispenser body 12 where an extension 22 is located having an adhesive chamber 24 connected to an adhesive discharge orifice 26.

A plunger 28 is located within the adhesive passageway 18, and has a ball 30 at its lower end which is shaped to engage a seat 32 mounted within the extension 22 between its adhesive chamber 24 and adhesive discharge orifice 26. The plunger 28 is axially movable within passageway 18 by operation of a solenoid 34 which is mounted within the dispenser body 12 by a sleeve 35. The solenoid 34 is energized by an electric lead 36 connected by a line 38 from a power supply (not shown). In response to operation of the solenoid 34, the plunger 28 is axially movable within the adhesive passageway 18 between a closed position shown in FIG. 1 wherein the ball 30 engages the seat 32 to prevent the passage of adhesive into the discharge orifice 26, and an open position (not shown) wherein the ball 30 disengages the seat 32 to permit the flow of adhesive from the adhesive chamber 24 into the adhesive discharge orifice 26.

Preferably, a heating element 40 is mounted near the base of the dispenser body 12 and is connected by an electrical lead 42 to the power supply line 38. An RTD (not shown) is carried within the dispenser body 12 near the heating element 40 which is effective to sense the temperature of the dispenser body 12 thereat and permit adjustment of the current to heating element 40 so that the hot melt adhesive within the adhesive passageway 18 can be heated to the desired temperature.

Figure 3:
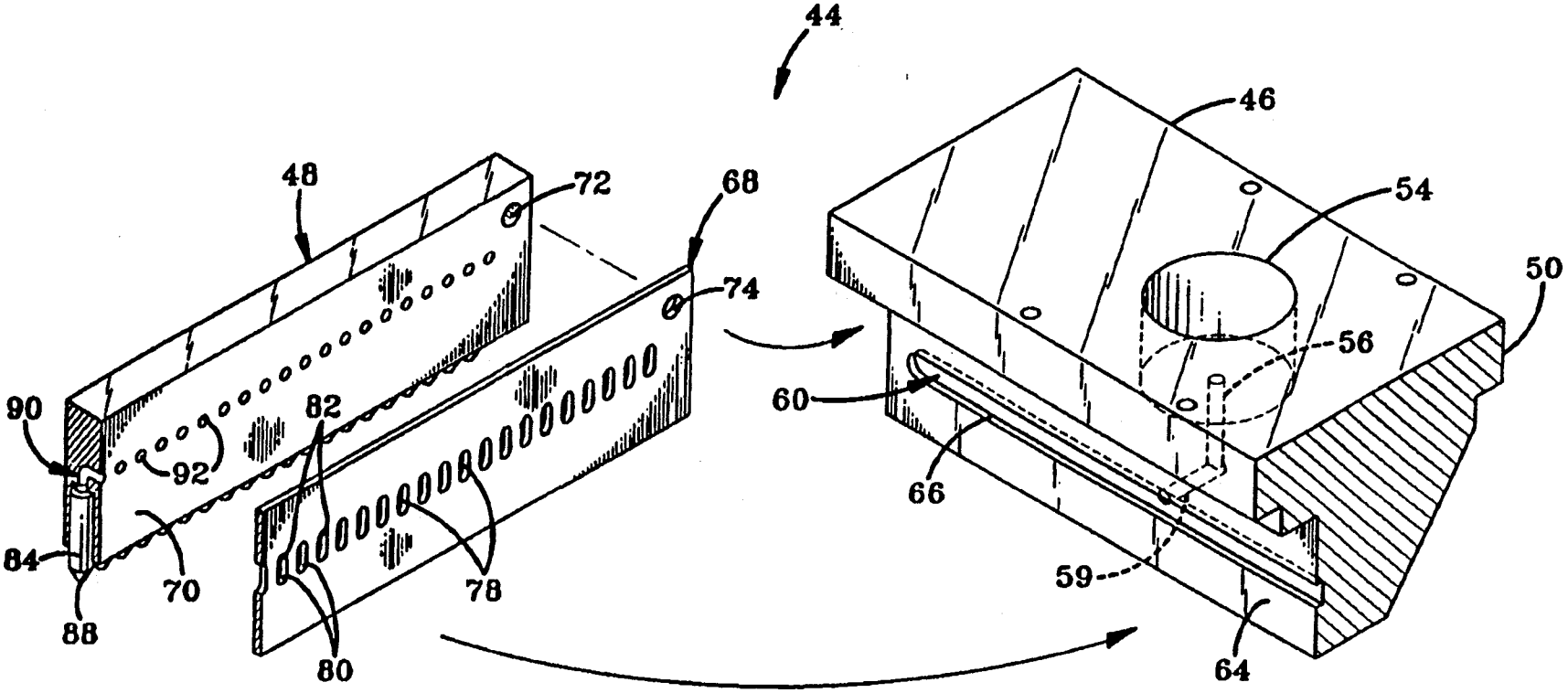
FIG. 3 is an unassembled, schematic view in partial cross section of the embodiment of the nozzle assembly shown in FIGS. 1 and 2.

In the embodiment of FIGS. 1–3, a nozzle assembly 44 is mounted at the base of the dispenser body 12 which comprises a nozzle body 46 and a nozzle plate 48. The overall exterior configuration of the nozzle body 46 and nozzle plate 48 is preferably similar to the T-bar nozzle disclosed in U.S. Pat. No. 5,027,976 to Scholl et al. Such exterior configuration of nozzle assembly is intended to substantially prevent a change in temperature of the hot melt adhesive at a point where it is discharged from the discharge orifice 26 of the adhesive passageway 18 in dispenser body 12 to the outlets of the nozzle plate 48 described below. This feature does not constitute part of the present invention, and is therefore not described herein.

As viewed in FIGS. 1–3, the nozzle body 46 is formed with an upper flange 50 which abuts the bottom wall of dispenser body 12 and is connected thereto by screws 52. The terms "upper", "lower", "top" and "bottom" are meant to refer to directions according to the position of the dispenser 10 as depicted in the FIGS., and are not to be considered as limiting the use of dispenser 10 to any particular orientation. A cavity 54 is formed in the upper portion of nozzle body 46 which receives the extension 22 of dispenser body 12 such that the discharge orifice 26 in the extension 22 aligns with a feed passageway 56 formed in the nozzle body 46. Preferably, an O-ring 58 is located at the bottom of the cavity 54 in nozzle body 46 to provide a seal with the extension 22. A contact plate 55 is mounted by a screw 57 to the base of nozzle body 46 to protect the nozzle assembly 44 from abrasive contact with a substrate. The nozzle assembly 44 is a "stand-off" assembly, i.e., it is not designed to contact a substrate, and it is therefore not intended that plate 55 necessarily ride atop the substrate during an operating run but merely prevent contact with the nozzle assembly 44 in the event the substrate should ride upwardly toward the assembly 44.

In the embodiment of FIGS. 1–3, the feed passageway 56 forms part of an internal adhesive flow path within nozzle body 46 which also includes a connector bore 59 and an elongated, longitudinally extending distribution slot or channel 60. The feed passageway 56 extends substantially vertically downwardly within nozzle body 46 and intersects the connector bore 59, which, in turn, extends substantially horizontally from the feed passageway 56 to the distribution channel 60. As best seen in FIG. 3, distribution channel 60 is substantially horizontally oriented, and extends inwardly from a face 64 of a nozzle body 46 forming an elongated discharge outlet 66 thereat.

In the embodiment of FIGS. 1–3, a shim 68 is sandwiched between the inner face 64 of nozzle body 46 and an inner face 70 of the nozzle plate 48. Preferably, the nozzle plate 48 and shim 68 are formed with bores 72 and 74, respectively, which receive an alignment pin 76 carried by the nozzle body 46 for purposes of properly positioning the nozzle plate 48 and shim 68 with respect to the nozzle body 46. The shim 68 is a rectangular-shaped plate formed with a number of longitudinally spaced, vertically oriented oval-shaped slots 78 each having a lower end 80 and an upper end 82. Preferably, the cross sectional area of each of the slots 78 in shim 68 is less than the cross sectional area of the distribution channel 60. As viewed in FIG. 1, when the shim 68 is mounted in position between the nozzle body 46 and nozzle plate 48, the lower end 80 of each slot 78 in the shim 68 communicates with the outlet 66 of the distribution channel 60 in nozzle body 46.

As viewed in FIGS. 1–3, the nozzle plate 48 is a rectangular-shaped block which carries a number of longitudinally spaced nozzle tips 84 each formed with a throughbore 86 having an outlet 88. A number of L-shaped discharge passages 90 are formed in nozzle plate 48 each having an inlet portion 92 extending substantially horizontally inwardly from the inner face 70 of nozzle plate 48, and a vertical portion 94 extending perpendicularly to the inlet portion 92 and connected to a throughbore 86 of one of the nozzle tips 84. In the presently preferred embodiment, at least the inlet portion 92 of each connector passage 90 has a smaller cross sectional area than that of the distribution channel 60. As viewed in FIGS. 1–4, the cross sectional areas of channel 60 and the inlet portion 92 of connector passages 90 are meant to refer to cross sections taken transverse to their respective longitudinal axis. With the shim 68 positioned between the nozzle body 46 and nozzle plate 48, the inlet portion 92 of each connector passage 90 in the nozzle plate 48 aligns with the upper end 82 of one of the slots 78 within the shim 68.

The feed passageway 56, connector passage 59, distribution channel 60, slots 78 and discharge passages 90 collectively form a flow path for the hot melt adhesive between the discharge orifice 26 of the dispenser extension 22 to the nozzle tips 84. As described in more detail below in connection with a discussion of the operation of dispenser 10, this flow path is particularly intended to eliminate cut off drool from the nozzle tips 84 when the dispenser 10 is operated intermittently.

Figure 4:
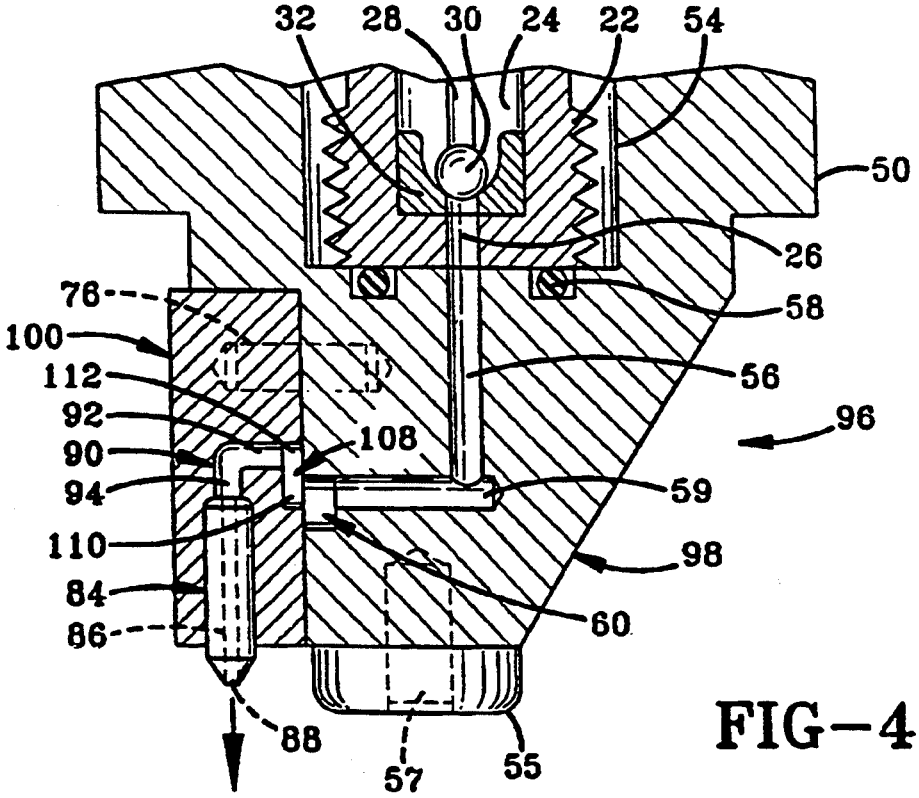
FIG. 4 is a view similar to FIG. 2 of an alternative embodiment of the nozzle assembly wherein the shim between the nozzle body and nozzle plate is eliminated.
Figure 5:
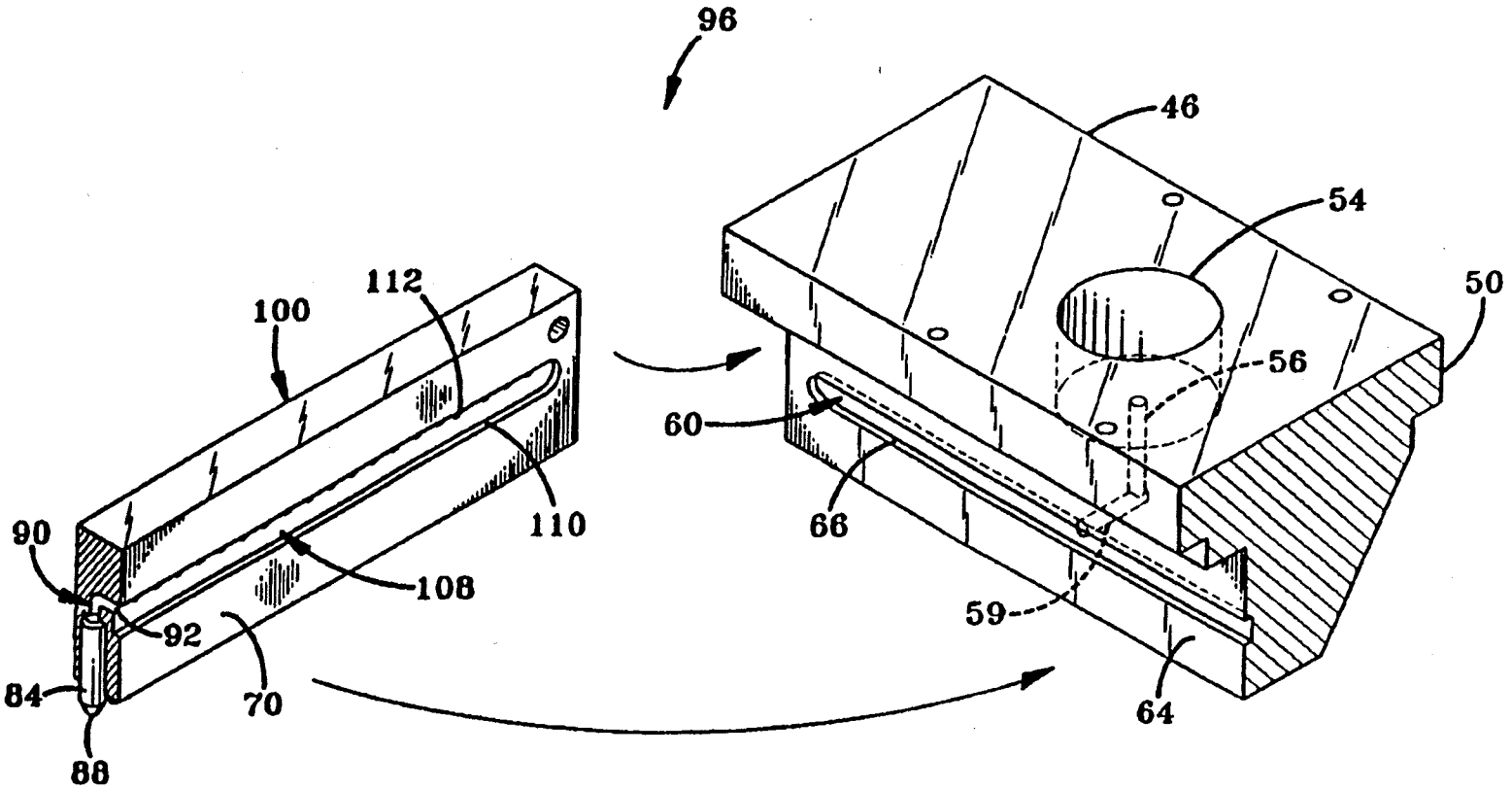
FIG. 5 is an unassembled, schematic view of the nozzle assembly of FIG. 4.

Embodiment of FIGS. 4 and 5

With reference to FIGS. 4 and 5, an alternative embodiment of a nozzle assembly 96 is illustrated in which the shim 68 of FIGS. 1–3 is eliminated, and a nozzle body 46 and modified nozzle plate 100 are provided. The structure in FIGS. 5 and 6 which is common to that of the above-described embodiment is identified with the same reference numerals in FIGS. 5 and 6 as in FIGS. 1–3.

The nozzle plate 100 of nozzle assembly 96 is identical to the nozzle plate 48 of FIGS. 1–3, except that an elongated, longitudinally extending distribution slot 108 is formed in the nozzle plate 48 which extends inwardly from its inner face 70. This distribution slot 108 has a lower portion 110, and an upper portion 112 within which the inlet portion 92 of each connector passage 90 in nozzle plate 100 is located. Preferably, the cross sectional area of the distribution slot 108 is less than that of the distribution channel 60 in the nozzle body 46. The nozzle body 46 and nozzle plate 100 mount directly to one another, i.e., the face 64 of nozzle body 46 contacts the inner face 70 of nozzle plate 100, such that the outlet 66 of distribution channel 60 in nozzle body 46 intersects the lower portion 110 of distribution slot 108. As best seen in FIG. 4, the outlet 66 of distribution channel 60 is located vertically beneath the inlet portion 92 of each connector passage 90 so that adhesive discharged into the distribution slot 108 of nozzle plate 100 and travels vertically upwardly, against the influence of gravity, into the connector passages 90 of nozzle plate 100.

Figure 6:
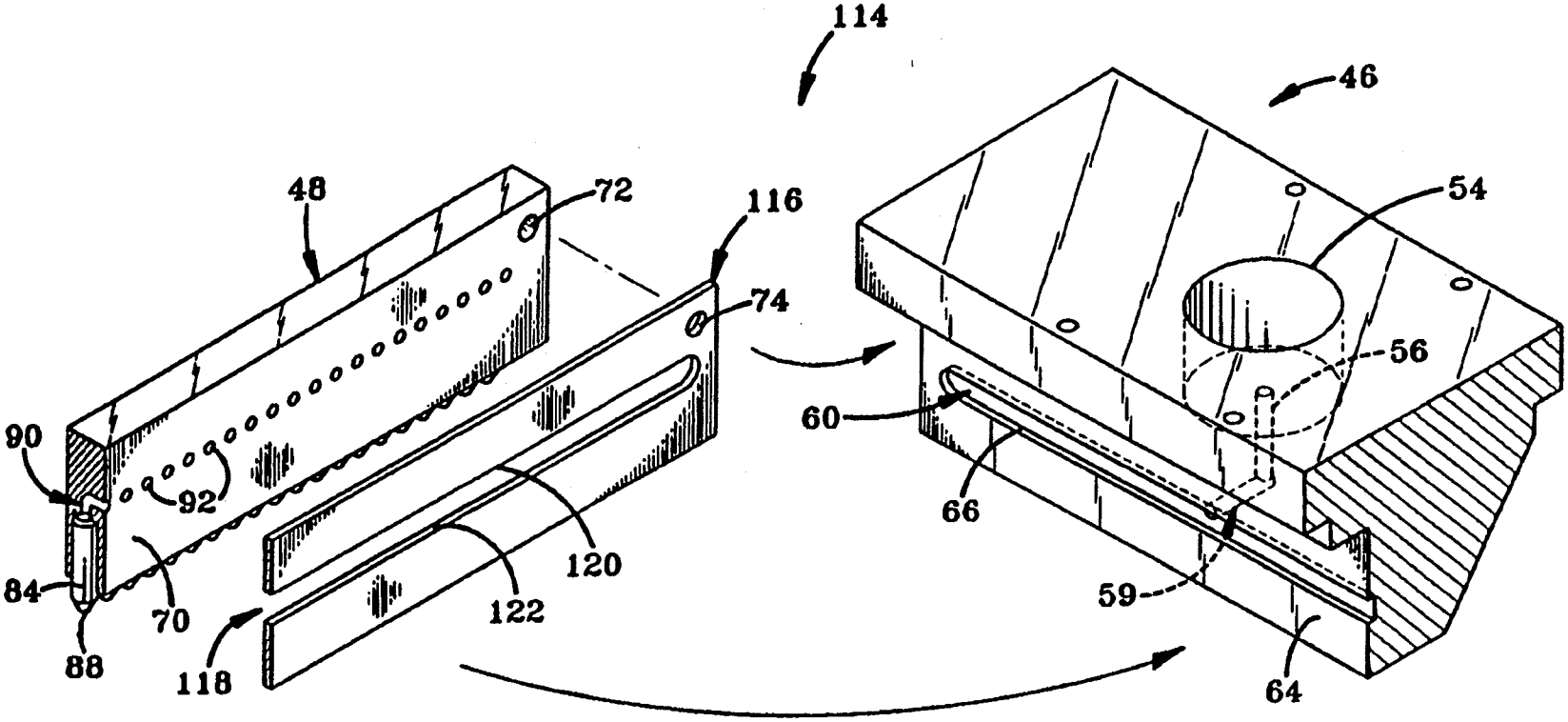
FIG. 6 is an unassembled, schematic view of a still further embodiment of the nozzle assembly herein.

Embodiment of FIG. 6

A still further embodiment of a nozzle assembly 114 is illustrated in FIG. 6 which comprises a combination of the nozzle body 46 and nozzle plate 48 of FIGS. 1 and 2, and a modified shim 116. The shim 116 is a rectangular plate formed with an elongated distribution slot 118 having an upper portion 120 and a lower portion 122, instead of a number of oval, vertical slots 78 as in shim 68 of FIGS. 1–3. The distribution slot 118 preferably has a smaller cross sectional area than that of the distribution channel 60 in the nozzle body 46. With the nozzle body 46 and nozzle plate 48 assembled, the lower portion 122 of distribution slot 118 communicates with the outlet 66 of distribution channel 60 in the same relative position as with the lower portion 80 of slots 78 in shim 68, and the upper portion 120 of distribution slot 118 connects to the inlet portion 92 of each connector passage 90 in the nozzle plate 48. See FIG. 3. Accordingly, the same type of flow path for the adhesive is obtained in the nozzle assembly 114 of FIG. 6 as in the previously described embodiments of FIGS. 1–3 and 4–5, wherein the adhesive must flow vertically upwardly against the influence of gravity in the course of passage between the nozzle body 46 or 99 and into the connector passages 90 of nozzle plate 48.

Figure 7:
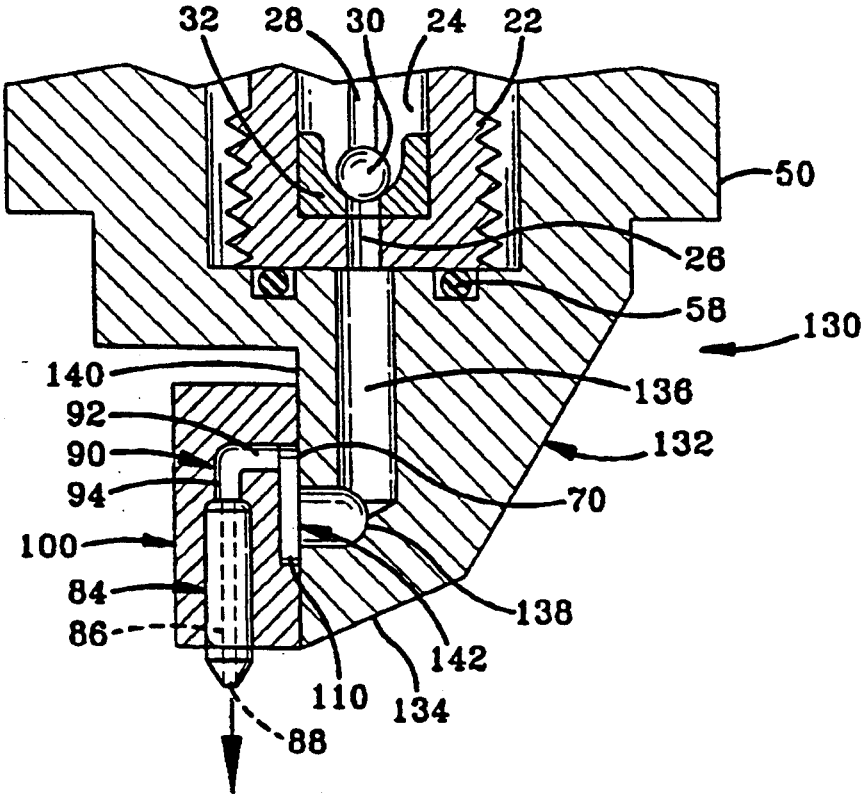
FIG. 7 is a view similar to FIG. 4 except with a modified nozzle body and shortened internal adhesive flow passageway within the nozzle body.

Embodiment of FIG. 7

Another embodiment of a nozzle assembly 130 is illustrated in FIG. 7 which includes the same nozzle plate 100 of FIGS. 4 and 5 mounted to a modified nozzle body 132. As mentioned above, the nozzle body 46 of FIGS. 1–6 has a tapered, external configuration similar to that disclosed in U.S. Pat. No. 5,027,976 to Scholl et al, owned by the assignee of this invention. The nozzle body 132 differs from that design in that it does not have such a tapered external configuration, except for an upwardly tapered bottom surface 134 as depicted in FIG. 7. Addition-ally, the nozzle body 132 is formed with an internal adhesive flow path wherein the connector passage 59 of the previous embodiments is eliminated. The internal flow path of this embodiment includes a vertically oriented supply passage 136 which intersects a longitudinal, generally horizontally disposed distribution channel 138 extending inwardly from the inner face 140 of nozzle body 132. This inner face 140 abuts the face 70 of nozzle plate 100 so that the outlet 142 of distribution channel 138 is connected to the lower portion 110 of the distribution slot 108 in nozzle plate 100. As in the previous embodiments, a vertical flow path is thus created between the distribution channel 138 in the nozzle body 132, and the inlet portion 92 of each connector passage 90 in the nozzle plate 100. Additionally, the cross sectional area of the distribution channel 138 in the nozzle body 132 is greater than the cross sectional area of the distribution slot in nozzle plate 100.

Figure 8:
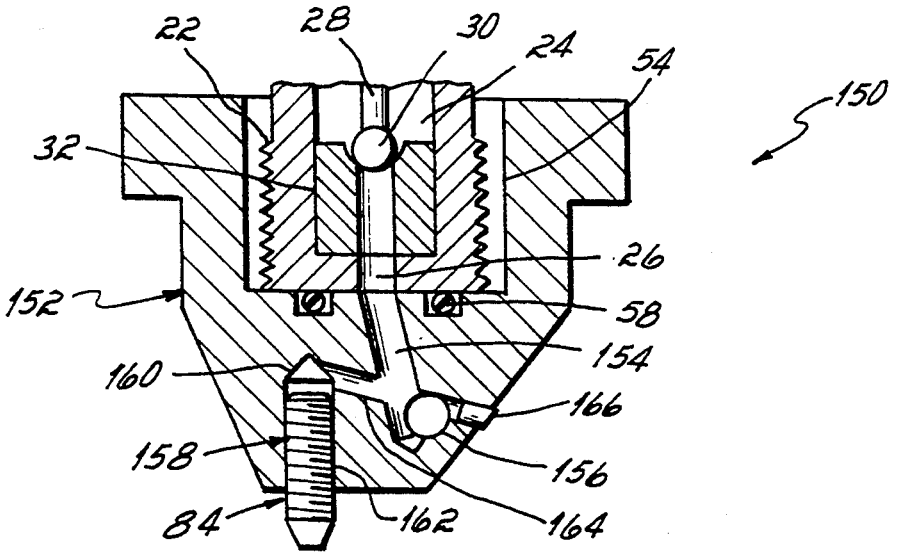
FIG. 8 is a schematic view in partial cross section of a further alternative embodiment of the nozzle assembly herein.
Figure 9:
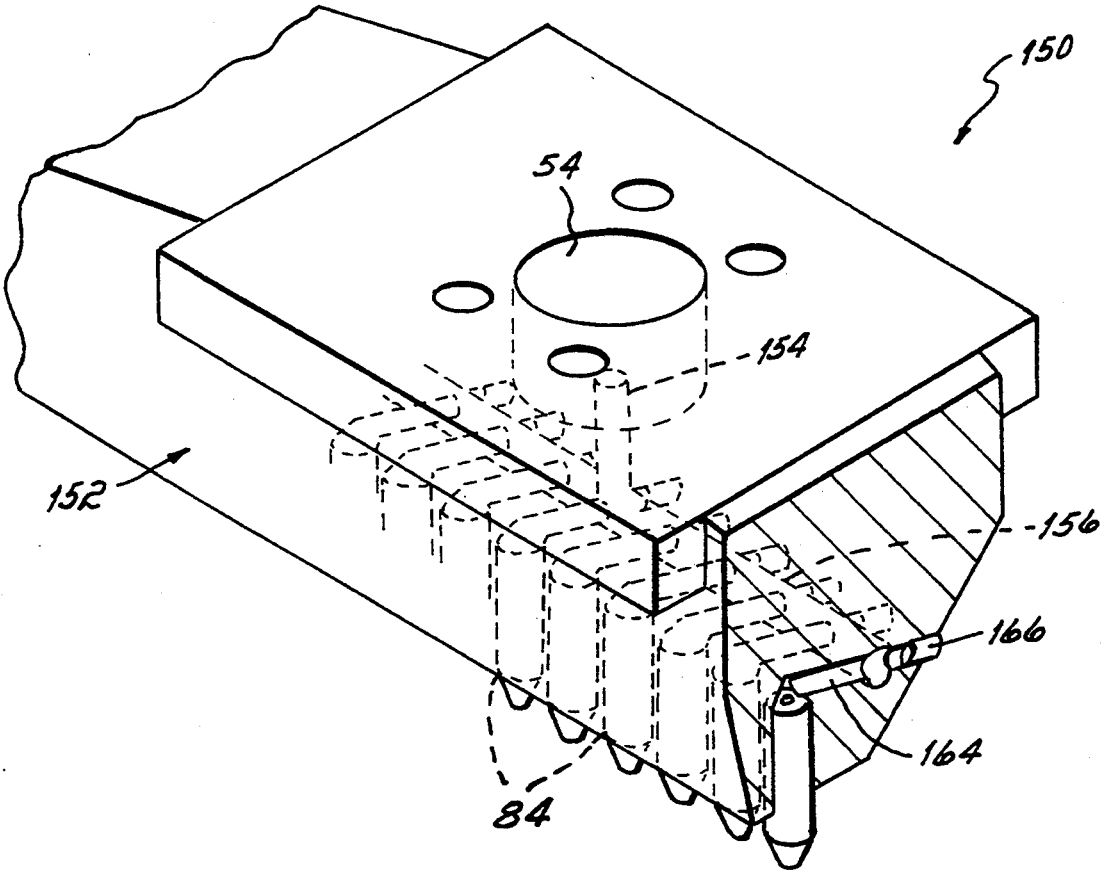
FIG. 9 is a side view in partial cross section of the nozzle assembly of FIG. 8.

Embodiment of FIGS. 8 and 9

A still further embodiment of a nozzle assembly 150 is illustrated in FIGS. 8 and 9 which has a tapered external configuration similar to that disclosed in U.S. Pat. No. 5,027,976 to Scholl et al, owned by the assignee of this invention. The nozzle assembly 150 of this embodiment differs from those described above in that no nozzle plate 48 or 100 is employed. Instead, the nozzle assembly 150 includes a nozzle body 152 which directly mounts a number of nozzle tips 84. The upper portion of nozzle body 152, and its connection to the dispenser 12, are identical to that described above in the previous embodiments and the same reference numbers are used to depict structure common to that described above.

As shown in FIG. 8, the discharge orifice 26 of the dispenser 10 is connected to a feed passage 154 which extends vertically downwardly within nozzle body 152 at an angle, preferably of about 12°, with respect to the longitudinal axis of the plunger 28 and discharge orifice 26. The feed passage 154 is connected at approximately the midpoint of a distribution bore 156 which extends longitudinally along the entire length of the nozzle body 152. Plugs or dowels (not shown) are brazed to the nozzle body 152 at each end of the distribution bore 156 to form a seal thereat.

The nozzle body 152 is formed with a number of substantially vertically oriented discharge passageways 158 each having an inlet portion 160 and a threaded outlet portion 162. Each of the threaded outlet portions 162 of the discharge passageways 158 mounts a nozzle tip 84 of the type described above. The inlet portion 160 of each discharge passageway 158 is connected to one end of a connector bore 164. These connector bores 164 extend from one face of the nozzle body 152, where they are plugged by a rod or dowel 166 brazed to the nozzle body 152, and intersect the distribution bore 156. Each of the connector bores 164 extends vertically upwardly from the distribution bore 156 to the inlet portion 160 of a discharge passageway 158 at an angle of approximately 15° relative to horizontal as viewed in FIG. 8. Adhesive introduced from the feed passage 154 into the distribution bore 156 therefore travels vertically upwardly along the connector bores 164 to the inlet portion 160 of each discharge passageway 158. In the presently preferred embodiment, both the connector bore 164 and inlet portion 160 of discharge passageways 158 have a smaller cross sectional area than the cross sectional area of the distribution bore 156.

Operation of Dispenser

An important aspect of this invention is a capability to avoid the formation of "cut off drool" from the nozzle tips 84, i.e., thin, elongated strands or strings of adhesive, particularly when the flow of adhesive from the dispenser 10 is alternately turned on and off. It is believed that two structural aspects of each of the nozzle assemblies 44, 96, 114, 130 and 150 herein account for the substantial elimination of cut off drool in this invention. For purposes of discussion, reference is made to the nozzle assembly 44 depicted in FIGS. 1 and 2, it being understood that the nozzle assemblies 96, 114, 130 and 150 operate in essentially the identical manner.

As mentioned above, an adhesive flow path is formed in the nozzle body 46 and nozzle plate 48 between the discharge orifice 26 of extension 22 and the discharge outlet 88 of each nozzle tip 84. Adhesive is introduced into the feed passageway 56 of nozzle body 46 from the extension 22 and flows through the horizontal connector passage 59 into the elongated distribution channel 60 at the face 64 of nozzle body 46. The adhesive is emitted from the outlet 66 of the distribution channel 60 and flows vertically upwardly along the individual slots 78 in the shim 68 to the inlet portion 92 of each discharge passage 90 formed in the nozzle plate 48. The adhesive then enters the vertical portion 94 of each discharge passage 90 and is transferred vertically downwardly to the through-bore 86 of each nozzle tip 84. The adhesive is ejected from the discharge outlet 88 of each nozzle tip 84 to form a plurality of thin, closely spaced extruded beads of adhesive (not shown).

When the flow of adhesive is terminated, i.e., by moving the plunger 28 of adhesive dispenser 10 to a closed position against the seat 32, the pressure applied to the adhesive stream to force it through nozzle body 46 and nozzle plate 48 is eliminated, but adhesive nevertheless remains along essentially the entire flow path through the nozzle body 46 and nozzle plate 48 to each of the nozzle tips 84. It is believed that leakage or drooling of this adhesive from the nozzle tips 84 is substantially eliminated by the construction of nozzle assembly 44 for several reasons. First, the distribution channel 60 formed in nozzle body 46 is located vertically below the inlet portion 92 of each connector passage 90 in nozzle plate 48. This same vertical flow path for the adhesive is present in the nozzle assemblies 96, 114, 130 and 150 of FIGS. 4–9. While a quantity of adhesive remains in the feed passageway 56, connector passage 59 and distribution channel 60 after the flow of adhesive is terminated, such adhesive is effectively prevented from flowing into the connector passages 90 of nozzle plate 48 because it cannot overcome gravity and flow vertically upwardly from the distribution channel 60 into the connector passages 90.

Having prevented the flow of adhesive from the feed passageway 56, connector passage 59 and distribution channel 60 into the nozzle plate 48, there nevertheless remains a quantity of adhesive within each of the discharge passages 90 within nozzle plate 48 and at least a portion of the throughbore 86 in each of the nozzle tips 84. Escape or leakage of this adhesive within the nozzle plate 48 is substantially prevented by forming the slots 78 in shim 68, and at least the inlet portion 92 of each connector passage 90 in nozzle plate 48, with smaller cross sectional areas than that of the distribution channel 60. At constant pressure and flow rate, the reduction in cross sectional area of the slots 78 in shim 68 and the inlet portion 92 of connector passages 90, compared to that of the distribution channel 60, results in an increase in velocity of the adhesive as it is transmitted from the nozzle body 46 to and through the nozzle plate 48. For most adhesives, the "machineability" or ability to shear is enhanced as velocity is increased. By increasing the velocity of the adhesive as it travels into and through the nozzle plate 48, the adhesive streams flowing through each of the nozzle tips 84 are more readily and cleanly sheared when the flow of adhesive from the dispenser 10 is intermittently interrupted. As a result, such adhesive streams within nozzle tips 84 tend to shear at least some distance upstream from their discharge outlets 88 thus producing a gap or space between the adhesive and such discharge outlets 88.

The reduction in cross sectional area of the inlet portion 92 of connector passages 90 in nozzle plate 48, compared to the distribution channel 60 in nozzle body 46, also creates a back pressure acting in an upstream direction. This back pressure tends to pull or draw the adhesive within the nozzle tips 84 upstream from their discharge outlets 88, further preventing any leakage of such adhesive when the flow from dispenser 10 is terminated. Additionally, the back pressure aids in producing an even distribution of adhesive along the distribution channel 60 in nozzle body 46 (FIGS. 1–6), the distribution channel 138 of nozzle body 130 (FIG. 7), the distribution slot 108 in the nozzle plate 100 of nozzle assembly 96 (FIGS. 4 and 5), the distribution slot 118 of the shim 116 of nozzle assembly 114 (FIG. 6), and, the distribution bore 156 of nozzle assembly 150 (FIGS. 8 and 9). Such even distribution of adhesive ensures that substantially the same volume or quantity of adhesive flows into each of the discharge passages 90 in nozzle plates 48 and 100 so that an extruded bead of adhesive having substantially the same volume is emitted from each nozzle tip 84.

As mentioned above, the nozzle assemblies 96, 114, 130 and 150 function in essentially the same manner as described above in connection with nozzle assembly 44. In each embodiment, a flow path is created wherein the adhesive must flow vertically upwardly in the course of passage between the nozzle body and nozzle plate. Additionally, a reduction in the cross sectional area of the flow path is formed, at least up to and through the discharge passageways, so that the velocity of the adhesive is increased through the nozzle plate to provide for better shearing of the adhesive when flow from the dispenser 10 is intermittently interrupted.

EXAMPLES

With reference to the embodiment of the nozzle assembly 130 illustrated in FIG. 7, experiments have been conducted with a nozzle body 132 and nozzle plate 100 having the following dimensions. The supply passage 130 has a diameter of 0.094 inches and the distribution channel 138 connected to supply passage 136 is preferably formed with a diameter of 0.094 inches. The nozzle plate 100 is formed with a distribution slot 142 having a vertical height as depicted in FIG. 7 of 0.173 inches and a depth of 0.030 inches. The distribution slot 142 is connected to the inlet portion 92 of connector passage 90 within nozzle plate 100 This inlet portion 92 has a diameter of 0.030 inches and connects to an outlet passage 94 having a diameter of 0.040 inches. The outlet portion 94 of connector passage 90 connects to the throughbore 86 of nozzle tip 84. Preferably, the diameter of the throughbore 86 and the discharge outlet 88 of nozzle tip 84 is in the range of 0.018 to 0.021 inches. In the embodiment of FIG. 7, the vertical distance from the center of distribution channel 138 in nozzle body 132, and the center of the inlet portion 92 of connector passage 90, is 0.088 inches. It should be understood that the dimensions given above are approximate and subject to variation due to tolerances and the like.

A nozzle assembly 130 with the above-identified dimensions has been run with each of the following adhesive materials and application conditions.

| | |
|---|---|
| EXAMPLE 1 | |
| Adhesive Type: | Eastabond LT-8080 available from the Eastman Kodak Company of Rochester, NY |
| Temperature: | 350° F. |
| Viscosity: | 1450 cps |
| Pressure: | 450 psi |
| Flow Rate: | 192 grams per min. |
| EXAMPLE 2 | |
| Material Type: | Eastabond A-3 (Eastman Kodak Co.) |
| Temperature: | 350° F. |
| Viscosity: | 1250 cps |
| Pressure: | 425 psi |
| Flow Rate: | 246 grams per min. |
| EXAMPLE 3 | |
| Material Type: | 34–2750 available from the National Starch and Chemical Corporation of Bridgewater, NJ |
| Temperature: | 350° F. |
| Viscosity: | 950 centipoise |
| Pressure | 500 psi |
| Flow Rate: | 648 grams per min. |

It has been observed that using the materials under the application conditions given above in Examples 1–3, the nozzle assembly 130 is operated intermittently with little or no formation of cut off drool from the nozzle tips 84.

As noted in the examples given above, the viscosity of the adhesive materials varied from 950 cps to 1450 cps. It is contemplated that adhesive materials having a higher viscosity, such as rubber-based adhesives with viscosities on the order of 2,000 cps, may require at least some modification of the dimensions of nozzle assembly 130. For example, it is contemplated that higher viscosity in adhesives would require an increase in the dimensions of the discharge outlet 88 in nozzle tip 84, the diameter of the inlet portion 92 of connector passage 90 and/or the depth of distribution slot 142 in the nozzle plate 100 in order to obtain the desired flow rate of adhesive through the nozzle assembly 130 without creating cut off drool during intermittent operation.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. Apparatus for dispensing extruded beads of thermoplastic material, comprising:

a dispenser formed with a substantially vertically oriented bore having an outlet for ejecting thermoplastic material, and valve means movable with respect to said outlet between an open position for permitting the discharge of thermoplastic material and a closed position for preventing such discharge;

a nozzle mounted to said dispenser, said nozzle having a fluid path located downstream of said valve means and extending from said dispenser outlet to a nozzle exit, said fluid path including:

(i) substantially horizontally oriented distribution means having an inlet portion communicating with said outlet of said dispenser for receiving thermoplastic material, said distribution means having a cross sectional area;

(ii) a plurality of substantially vertically oriented discharge passageways each having an inlet and a discharge outlet, the discharge outlets forming the exit of the fluid path, said discharge outlets of said discharge passageways being spaced laterally away from said movable means and said bore, each of said inlets having a cross sectional area which is smaller than said cross sectional area of said distribution means, said inlets of said discharge passageways being located vertically above said distribution means;

(iii) transfer means for directing the thermoplastic material, against the influence of gravity, from said distribution means into said inlets of said discharge passageways whereby thermoplastic material is retained in the distribution means and in the transfer means of the fluid path, and the distribution means the discharge passageways and the transfer means remain in fluid communication when the movable valve means is in the open position and when the movable valve means is in the closed position.

2. Apparatus for dispensing extruded beads of thermoplastic material, comprising:

a dispenser formed with a substantially vertically oriented bore having an outlet for ejecting thermoplastic material, and means movable with respect to said outlet between an open position for permitting the discharge of thermoplastic material and a closed position for preventing such discharge;

a nozzle body mounted to said dispenser, said nozzle body including (i) substantially horizontally oriented distribution means having an inlet portion communication with said outlet of said dispenser for receiving thermoplastic material wherein said distribution means includes a longitudinally extending distribution bore and a feed passage interconnecting said outlet of said dispenser with said distribution bore, said distribution bore having a cross sectional area;

(ii) a plurality of substantially vertically oriented discharge passageways each having an inlet and a discharge outlet, said discharge outlets of said discharge passageways being spaced laterally away from said movable means and said bore and longitudinally spaced along said distribution bore, said inlets of said discharge passageways being located vertically above said distribution bore, each of said inlets having a cross sectional area which is smaller than said cross sectional area of said distribution bore;

(iii) transfer means formed in said nozzle body and effective to direct the thermoplastic material, against the influence of gravity, from said distribution bore into said inlets of said discharge passageways, wherein thermoplastic material is retained in the distribution bore and int he transfer means after the movable means closes the dispenser outlet.

3. The apparatus of claim 2 in which said transfer means comprises a plurality of vertically upwardly angled connector passages each having a lower end connected to said distribution bore and an upper end connected to said inlets of said discharge passageways.

4. Apparatus for dispensing a number of spaced, extruded beads of thermoplastic material, comprising:

a dispenser formed with a substantially vertically oriented bore having an outlet for ejecting thermoplastic material, and valve means movable with respect to said outlet between an open position for permitting the discharge of thermoplastic material therethrough and a closed position for preventing such discharge;

a nozzle having a nozzle body mounted to said dispenser, said nozzle body having a fluid path located downstream of said valve means and extending from said dispenser outlet to a nozzle exit, the fluid path including an elongated, substantially horizontally oriented distribution bore having a cross sectional area and a feed passage interconnecting said distribution bore with said outlet of said dispenser;

said fluid path of said nozzle body including a plurality of substantially vertically oriented discharge passageways each having an inlet portion and a discharge outlet, the discharge outlets defining the exit of the fluid path, the discharge passageways being spaced laterally from the dispenser bore and said movable valve means, each of said inlet portions having a cross sectional area which is smaller than said cross sectional area of said distribution bore and which is located vertically above said distribution bore;

said fluid path of said nozzle body including transfer means for directing the thermoplastic material, against the influence of gravity, from said distribution bore into said inlet portion of each of said discharge passageways, wherein thermoplastic material is retained in the distribution bore and in the transfer means of the fluid path, and the distribution the discharge passageways and the transfer means remain in fluid communication when the movable valve means is in the open position and when the movable valve means is in the closed position.

5. The apparatus of claim 4 in which said transfer means comprises a number of vertically upwardly angled connector passages each having a lower end connected to said distribution bore and an upper end connected to said inlet of one of said discharge passageway.

6. The apparatus of claim 4 in which said discharge passageways are longitudinally spaced along said distribution bore, each of said discharge passageways having an outlet portion which mounts a nozzle tip.

7. A nozzle for ejecting extruding beads of thermoplastic material, comprising:

a dispenser formed with a substantially vertically oriented bore having an outlet for ejecting thermoplastic material, and valve means movable with respect to said outlet between an open position for permitting the discharge of thermoplastic material therethrough and a closed position for preventing such discharge;

a nozzle body, said nozzle body having a fluid path located downstream of said movable valve means and extending from said dispenser outlet to a nozzle exit, the fluid path including an elongated, substantially horizontally oriented distribution bore having a cross sectional area and a feed passage interconnecting said distribution bore with said outlet of said dispenser;

said fluid path of said nozzle body further including a plurality of substantially vertically oriented discharge passageways each having an inlet portion and a discharge outlet, the discharge outlets defining the exit of the fluid path, said passageways being spaced laterally from said bore and said movable valve means, each of said inlet portions having a cross sectional area which is smaller than said cross sectional area of said distribution bore and which is located vertically above said distribution bore;

said nozzle body being formed with transfer means for directing the thermoplastic material, against the influence of gravity, from said distribution bore into said inlet portion of each of said discharge passageways, whereby thermoplastic material is retained in the distribution means and in the transfer means of the fluid path, and the distribution bore the discharge passageways and the transfer means remain in fluid communication when the movable valve means is in the open position and when the movable valve means is in the closed position.

8. A nozzle for ejecting extruding beads of thermoplastic material, comprising:

a dispenser formed with a substantially vertically oriented bore having an outlet for ejecting thermoplastic material, and means movable with respect to said outlet between an open position for permitting the discharge of thermoplastic material therethrough and a closed position for preventing such discharge;

a nozzle body, said nozzle body being formed with an elongated, substantially horizontally oriented distribution bore having a cross sectional area and a feed passage interconnecting said distribution bore with said outlet of said dispenser;

said nozzle body being formed with a plurality of substantially vertically oriented discharge passageways each having an inlet portion and a discharge outlet, said passageways being spaced laterally from said bore and said movable means, each of said inlet portions having a cross sectional area which is smaller than said cross sectional area of said distribution bore and which is located vertically above said distribution bore;

said nozzle body being formed with transfer means for directing the thermoplastic material, against the influence of gravity, from said distribution bore into said inlet portions of each of said discharge passageways, whereby thermoplastic material is retained in the distribution means and in the transfer means after the movable means closes the dispenser outlet;

wherein said transfer means comprises a number of vertically upwardly angled connector passages each having a lower end connected to said distribution bore and an upper end connected to one of said inlet portions of said discharge passageways.

9. The apparatus of claim 7 in which said discharge passageways are longitudinally spaced along said distribution bore, each of said discharge passageways having an outlet portion which mounts a nozzle tip.

10. The method of discharging a number of extruded beads of thermoplastic material, comprising:

transmitting thermoplastic material from a dispenser outlet to a fluid path in a nozzle via operation of a movable valve means which is movable with respect to the dispenser outlet between an open position for permitting discharge of the material and a closed position for preventing such discharge, the fluid path located downstream of the movable valve means and including a distribution passage and a plurality of discharge passageways having inlet and outlet portions;

directing the thermoplastic material vertically upwardly from the distribution passage, against the influence of gravity, into the inlet portions of the plurality of discharge passageways;

transmitting the thermoplastic material through the discharge passageways at a higher velocity than the velocity at which the thermoplastic material is transmitted through the distribution passage;

extruding a bead of thermoplastic material from the outlet portions of each of the discharge passageways, whereby thermoplastic material is retained in the distribution passage and in the discharge passageways of the fluid path after the movable valve means closes the dispenser outlet, the distribution passage and the discharge passageways remaining in fluid communication during extrusion when the dispenser outlet is open and after extrusion when the dispenser outlet is closed.

11. The method of discharging a number of extruded beads of thermoplastic material, comprising:

intermittently transmitting thermoplastic material from a dispenser outlet to a fluid path in a nozzle via operation of a movable valve means which is movable with respect to the dispenser outlet between an open position for permitting discharge of the material and a closed position for preventing such discharge, the fluid path located downstream of the movable valve means and including a distribution passage and a plurality of discharge passageways having inlet and outlet portions;

directing the thermoplastic material vertically upwardly from the distribution passage, against the influence of gravity, into the inlet portions of the plurality of discharge passageways;

extruding a bead of thermoplastic material from each of the outlet portions of the discharge passageways;

increasing the velocity of the thermoplastic material in the course of movement from the distribution passage through the discharge passageways so that when the flow of thermoplastic material is intermittently interrupted, via operation of the movable valve means, the extruded beads of thermoplastic material are sheared upstream from the outlet portions of the discharge passageways, whereby thermoplastic material is retained in the distribution passage and in the discharge passageways of the fluid path after the movable valve means closes the dispenser outlet, the distribution passage and the passageways remaining in fluid communication during extrusion when the dispenser outlet is open and after extrusion when the dispenser outlet is closed.

12. The method of claim 11 in which said step of increasing the velocity of the thermoplastic material comprises transmitting the thermoplastic material from the distribution passage having a cross sectional area, into the inlet portion of each discharge passageway which has a comparatively smaller cross sectional area.

13. The method of discharging a number of extruded beads of thermoplastic material, comprising:

intermittently transmitting thermoplastic material from a dispenser outlet to a fluid path in a nozzle via operation of a movable valve means which is movable with respect to the dispenser outlet between an open position for permitting discharge of the material and a closed position for preventing such discharge, the fluid path located downstream of said movable valve means and including a distribution passage and a plurality of discharge passageways having inlet and outlet portions;

directing the thermoplastic material vertically upwardly from the distribution passage, against the influence of gravity, into the inlet portions of the plurality of discharge passageways;

intermittently extruding a bead of thermoplastic material from each of the outlet portions of the discharge passageways;

creating a back pressure upstream from the outlet of each of the discharge passageways and downstream of the movable valve means, when the flow of thermoplastic material therethrough is intermittently interrupted, to maintain the thermoplastic material within the discharge passageways until flow of the thermoplastic material is resumed, the distribution passage and the passageways remaining in fluid communication during extrusion when the dispenser outlet is open and after extrusion when the dispenser outlet is closed.

14. The apparatus of claim 1 in which said nozzle comprises:

a nozzle body mounted to said dispenser, said nozzle body being formed with said distribution means which comprises a substantially horizontally oriented distribution channel having a cross sectional area; and a nozzle plate formed with said discharge passageways, said nozzle plate being mounted to said nozzle body so that the inlets of said discharge passageways are located vertically above said distribution channel in said nozzle body.

15. The apparatus of claim 14 in which said nozzle body is formed with a surface, said distribution channel extending longitudinally along said nozzle body and inwardly from said surface of said nozzle body, said distribution channel having an outlet at said surface of said nozzle body.

16. The apparatus of claim 15 in which said transfer means comprises a shim interposed between said nozzle body and said nozzle plate, said shim being formed with a plurality of substantially vertically oriented slots, each slot having a lower end connected to said outlet of said distribution channel and an upper end connected to said inlet of one of said discharge passageways.

17. The apparatus of claim 14 in which said transfer means comprises a shim interposed between said nozzle body and said nozzle plate, said shim being formed with an elongated, substantially horizontally oriented slot extending generally parallel with said distribution channel, the slot having a lower side connected to said distribution channel in said nozzle body and an upper side connected to the inlets of said discharge passageways in said nozzle plate.

18. The apparatus of claim 14 in which said nozzle body is formed with a first surface and said nozzle plate is formed with a second surface, the first and second surfaces abutting one another, said transfer means comprising an elongated, substantially horizontally oriented slot extending inwardly from said second surface of said nozzle plate and having a lower side connected to said distribution channel in said nozzle body and an upper side connected to the inlets of said discharge passageways.

19. The apparatus of claim 4 in which said nozzle body is formed with a surface, the distribution bore comprising an elongated, substantially horizontally oriented distribution channel extending longitudinally along said nozzle body and inwardly from said surface of said nozzle body, said distribution channel having an outlet at said surface of said nozzle body.

20. The apparatus of claim 19 in which said discharge passageways are formed in a nozzle plate, the nozzle plate being mounted to said nozzle body so that the inlet portions of said discharge passageways are located vertically above said distribution channel.

21. The apparatus of claim 20 in which said transfer means comprises a shim interposed between said nozzle body and said nozzle plate, said shim being formed with a plurality of substantially vertically oriented slots, each slot having a lower end connected to said outlet of said distribution channel and an upper end connected to the inlet portions of said discharge passageways.

22. The apparatus of claim 19 in which said fluid path further includes a vertically oriented feed passage adapted to connect to the dispenser outlet to receive thermoplastic material, and a connector passageway which interconnects said feed passage with said distribution channel.

23. The apparatus of claim 20 in which said transfer means comprises a shim interposed between said nozzle body and said nozzle plate, said shim being formed with an elongated, substantially horizontally oriented slot extending generally parallel with said distribution channel, the slot having a lower side connected to said distribution channel in said nozzle body and an upper side connected to said inlet portions of said discharge passageways.

24. The apparatus of claim 20 in which said nozzle body is formed with a first surface and said nozzle plate is formed with a second surface, the first and second surfaces abutting one another, said distribution channel extending inwardly from said first surface of said nozzle body, said transfer means comprising an elongated, substantially horizontally oriented slot extending inwardly from said second surface of said nozzle plate and having a lower side connected to said distribution channel in said nozzle body and an upper side connected to the inlet portions of said discharge passageways.

* * * * *

UNITED STATES PATENT AND TRADEMARK OFFICE

CERTIFICATE OF CORRECTION

PATENT NO. : 5,335,825

DATED : August 9, 1994

INVENTOR(S) : Wesley Fort

It is certified that error appears in the above-identified patent and that said Letters Patent is hereby corrected as shown below:

Column 7, Line 66, "Addition-ally" should be --Additionally--.

Claim 2, Column 12, Line 55, "communication" should be --communicating--.

Claim 2, Column 13, Line 11, "int he" should be --in the--.

Claim 4, Column 13, Line 55, "distribution the discharge passageways and the transfer means" should be --distribution bore the discharge passageways and the transfer means--.

Signed and Sealed this

Twenty-first Day of March, 1995

*Attest:*

Bruce Lehman

BRUCE LEHMAN

*Attesting Officer*

*Commissioner of Patents and Trademarks*